US009156275B2

(12) United States Patent
Olsen et al.

(10) Patent No.: US 9,156,275 B2
(45) Date of Patent: Oct. 13, 2015

(54) CONTINUOUS INK SUPPLY APPARATUS, SYSTEM AND METHOD

(75) Inventors: David N. Olsen, Corvallis, OR (US); David B Novak, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/002,972

(22) PCT Filed: Mar. 14, 2011

(86) PCT No.: PCT/US2011/028369

§ 371 (c)(1),
(2), (4) Date: Sep. 3, 2013

(87) PCT Pub. No.: WO2012/125150

PCT Pub. Date: Sep. 20, 2012

(65) Prior Publication Data

US 2013/0335466 A1 Dec. 19, 2013

(51) Int. Cl.
*B41J 2/175* (2006.01)

(52) U.S. Cl.
CPC ..... *B41J 2/17596* (2013.01); *B41J 2/175* (2013.01); *B41J 2/17509* (2013.01); *B41J 2/17513* (2013.01)

(58) Field of Classification Search
CPC .... B41J 2/17503; B41J 2/175; B41J 2/17513; B41J 2/1752; B41J 2/17523; B41J 2/17556; B41J 2/18596
USPC ..... 347/87
See application file for complete search history.

(56) References Cited

U.S. PATENT DOCUMENTS

| | | | | |
|---|---|---|---|---|
| 5,369,429 | A | 11/1994 | Erickson | |
| 5,469,201 | A | 11/1995 | Erickson et al. | |
| 5,719,609 | A * | 2/1998 | Hauck et al. | 347/85 |
| 5,852,459 | A | 12/1998 | Pawlowski, Jr. et al. | |
| 5,886,718 | A * | 3/1999 | Johnson et al. | 347/85 |
| 5,900,896 | A | 5/1999 | Barinaga et al. | |
| 5,971,529 | A | 10/1999 | Pawlowski, Jr. et al. | |
| 6,033,064 | A | 3/2000 | Pawlowski, Jr. et al. | |

(Continued)

FOREIGN PATENT DOCUMENTS

| | | | |
|---|---|---|---|
| CN | 1134886 | A | 11/1996 |
| CN | 1309025 | A | 8/2001 |

(Continued)

OTHER PUBLICATIONS

International Search Report and Written Opinion (ISR/WO) of the International Searching Authority/Korea (ISA/KR) for counterpart PCT parent application PCT/US2011/028369, mailed Nov. 25, 2011, 14 pages.

(Continued)

*Primary Examiner* — Julian Huffman
(74) *Attorney, Agent, or Firm* — North Shore Associates

(57) ABSTRACT

A continuous ink supply (CIS) apparatus, a CIS printer system and a method of CIS employ a one-way valve having a minimum negative activation pressure. The apparatus includes an off-axis ink supply to source liquid ink to a printhead of a printer. The one-way valve is positioned between the off-axis ink supply and the printhead. The minimum negative activation pressure at a printhead side of the one-way valve is at least enough to substantially precludes drooling from the printhead.

15 Claims, 4 Drawing Sheets

(56) References Cited

U.S. PATENT DOCUMENTS

| | | | |
|---|---|---|---|
| 6,065,829 | A | 5/2000 | Ruiz et al. |
| 6,109,741 | A | 8/2000 | Calatayud et al. |
| 6,142,617 | A | 11/2000 | Barinaga et al. |
| 6,273,560 | B1 | 8/2001 | Keefe et al. |
| 6,386,692 | B1 | 5/2002 | Cowger et al. |
| 6,422,693 | B2 | 7/2002 | Pawlowski, Jr. et al. |
| 6,719,414 | B2 | 4/2004 | Sole et al. |
| 6,739,706 | B2 | 5/2004 | Barinaga et al. |
| 6,796,644 | B1 | 9/2004 | Anderson, Jr. et al. |
| 7,413,296 | B2 | 8/2008 | Shiho et al. |
| 7,452,061 | B2 | 11/2008 | Childers et al. |
| 7,556,365 | B2 | 7/2009 | Stathem |
| 7,618,135 | B2 | 11/2009 | Stathem et al. |
| 7,735,985 | B2 | 6/2010 | Ward et al. |
| 2001/0006395 | A1 | 7/2001 | Pawlowski et al. |
| 2002/0015067 | A1* | 2/2002 | Studholme et al. ..... 347/19 |
| 2009/0267976 | A1 | 10/2009 | Lee et al. |
| 2010/0225726 | A1 | 9/2010 | Chan et al. |

FOREIGN PATENT DOCUMENTS

| | | | |
|---|---|---|---|
| CN | 1511087 | A | 7/2004 |
| JP | 2001038922 | A | 2/2001 |
| JP | 2003127411 | A | 5/2003 |

OTHER PUBLICATIONS

Epson America, Inc., Epson Stylus Pro WT7900: Features and Benefits, Epson America, Inc., Epson Professional Imaging, web page <http://www.epson.com/cgi-bin/Store/jsp/Pro/Series-StylusProWT7900/FandB.do?BV_UseBVCookie=yes >, copyright 2000-2013 Epson America, Inc. (3 pages).

* cited by examiner

CONTINUOUS INK SUPPLY APPARATUS, SYSTEM AND METHOD

CROSS-REFERENCE TO RELATED APPLICATIONS

N/A

STATEMENT REGARDING FEDERALLY SPONSORED RESEARCH OR DEVELOPMENT

N/A

BACKGROUND

Inkjet printers and related inkjet devices have proven to be reliable, efficient, and generally cost effective means for the accurate delivery of precisely controlled amounts of ink and other related liquid materials onto various substrates such as, but not limited to, glass, paper, cloth, transparencies and related polymer films. For example, modern inkjet printers for consumer market digital printing on paper offer printing resolutions in excess of 2400 dots per inch (DPI), provide printing speeds greater than 60 sheets per minute, and deliver individual droplets of ink in a 'drop-on-demand' method that are often measured in picoliters. The relatively low costs, high print quality and generally vivid color output provided by these modern inkjet printers has made these printers among the most common digital printers in the consumer market.

A potential drawback of many inkjet printers is a limited usage rate and a concomitant high intervention rate associated with on-axis ink supplies. Specifically, on-axis ink supplies are necessarily limited in how much ink is available due to a trade-off with scan speed and other mechanical considerations of the printhead in the printer. A solution is to provide an off-axis ink supply that either augments or completely supplants the on-axis supply. Such an off-axis ink supply, often referred to as a continuous ink supply (CIS) system, facilitates both providing larger reservoirs of ink and replenishing ink supplies without a need to interrupt ongoing printer operations (e.g., a current print job). Unfortunately, incorporation of a CIS system in modern printers is generally not as simple as adding an off-axis supply and running tubes to the printhead. Consideration of numerous issues involving connections, locations, air management and maintenance, for example, with respect to the printer render incorporation of CIS systems a non-trivial problem.

BRIEF DESCRIPTION OF THE DRAWINGS

The various features of examples may be more readily understood with reference to the following detailed description taken in conjunction with the accompanying drawings, where like reference numerals designate like structural elements, and in which.

Figure 1:
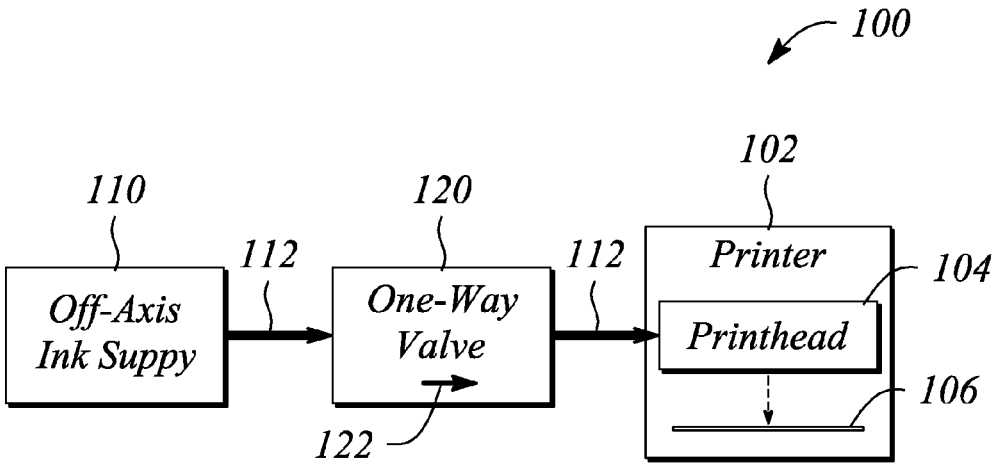
FIG. 1 illustrates a block diagram of a continuous ink supply (CIS) apparatus, according to an example of the principles described herein.

Certain examples have other features that are one of in addition to and in lieu of the features illustrated in the above-referenced figures. These and other features are detailed below with reference to the preceding drawings.

DETAILED DESCRIPTION

Examples in accordance with the principles described herein provide a continuous ink supply for an ink deposition system that employs ink. In particular, the continuous ink supply one of augments and replaces an on-axis ink reservoir of the ink deposition system. For example, the ink reservoir may be an ink reservoir of a printhead in a printer. The continuous ink supply may augment or replace the ink reservoir of the printhead (e.g., the on-axis ink reservoir) to one or both of facilitate performing bigger print jobs and significantly increase a service interval of the printhead. Examples of the continuous ink supply described herein may be employed to retrofit or modify existing ink deposition systems such as printers to provide the printer with a continuous ink supply. In other examples, a manufacturer may provide the ink deposition system with the continuous ink supply as either standard or optional equipment.

Herein, the term 'liquid ink' or simply 'ink' is defined as a fluid and includes either any liquid medium or a combination of a liquid carrier and substantially solid particles that is or may be deposited in a particular pattern or image by an ink deposition system such as a printer. Herein, 'continuous ink supply' is defined as a supply of liquid ink that is substantially uninterrupted in delivery to a printer. In some examples, the continuous ink supply may be replenished without halting a printing operation of the printer. Herein, 'drooling' with reference to a printhead is an adverse tendency for ink to leak or drip from the printhead. Drooling may be reduced, or in some examples, substantially minimized or substantially prevented, by maintaining a negative pressure in the ink supply of the printhead. For example, if the ink within a reservoir that services the printhead is maintained at a pressure that is negative relative to an ambient pressure outside of the printhead, the printhead may not exhibit drooling.

Also herein, a 'one-way' valve is defined as a valve that substantially limits, or in some examples substantially prevents, flow of a fluid in one direction while allowing flow in another direction. In particular, fluid may flow through the one-way valve in a first or downstream direction (i.e., also sometimes called the 'forward' direction). However, fluid flow in a second or upstream direction is largely prevented through the one-way valve. One-way valves are also sometimes referred to as check valves.

In some examples, one-way valves may further limit fluid flow in the downstream direction. In particular, in some examples one-way valves have a minimum activation pressure in the downstream direction. The minimum activation pressure is also sometimes referred to as cracking pressure and represents a pressure that activates the one-way valve to facilitate fluid flow in the downstream direction. In some examples, the minimum activation pressure is characterized by a pressure difference or differential pressure across the one-way valve. For example, the minimum activation pressure may be defined in terms of a pressure difference between the upstream side and the downstream side of the valve. However, when a pressure on a first side of the one-way valve is substantially zero relative to an ambient pressure, the minimum activation pressure may be equivalently characterized by a particular pressure at a second side (i.e., different from the first side) of the one-way valve. In particular, if a pressure on an upstream side of the one-way valve is substantially zero relative to the ambient pressure, the minimum activation pressure may be defined only in terms of the pressure also relative to the ambient pressure on a downstream side. Such a characterization is employed herein and the minimum activation pressure is referred to as a 'minimum negative activation pressure.'

Specifically, herein the minimum negative activation pressure of a one-way valve is defined as a minimum or lowest negative pressure of a fluid downstream of the one-way valve at which the one-way valve may open to allow fluid to flow. By 'negative' it is meant that the fluid pressure has a negative value (i.e., is less than zero). Also, as used herein all pressures are defined as being relative to an ambient pressure outside of a structure that confines and holds the fluid (e.g., outside of a fluid conduit connected to the downstream side of the one-way valve). As such, when a pressure of the fluid downstream of the one-way valve is more negative than the minimum negative activation pressure (i.e., when the downstream fluid pressure has both a negative value and a magnitude that is greater than a magnitude of the minimum negative activation pressure), the one-way valve opens and fluid is able to flow through the one-way valve. Alternatively, when the downstream fluid pressure is less negative than the minimum negative activation pressure (i.e., closer to zero than the minimum negative activation pressure), the fluid is substantially prevented from flowing in the forward or downstream direction. Note that fluid flow in both directions is also substantially prevented when the fluid pressure downstream of the one-way valve is positive (i.e., equal to or greater than zero) given the one-way nature of the one-way valve.

Further herein, a 'memory circuit' is defined as a circuit, typically implemented as an integrated circuit (IC) or 'chip,' that provides information to the printer regarding characteristics of the ink supply. Characteristics to which the information pertains may include, but are not limited to, one or more of an initial quantity of ink, a remaining quantity of ink, a type of ink, an ink color, and an ink cartridge identification number (e.g., model number, serial number, etc.).

Further, as used herein, the article 'a' is intended to have its ordinary meaning in the patent arts, namely 'one or more'. For example, 'a printhead' means one or more printheads and as such, 'the printhead' means 'the printhead(s)' herein. Also, any reference herein to 'top', 'bottom', 'upper', 'lower', 'up', 'down', 'front', back', 'left' or 'right' is not intended to be a limitation herein. Herein, the term 'about' when applied to a value generally means plus or minus 10% unless otherwise expressly specified. Moreover, examples herein are intended to be illustrative only and are presented for discussion purposes and not by way of limitation.

FIG. 1 illustrates a block diagram of continuous ink supply (CIS) apparatus 100, according to an example of the principles described herein. The CIS apparatus 100 may be used to supply liquid ink to an ink deposition system. The ink deposition system 102 may deposit the supplied liquid ink in a specific or directed pattern on a substrate. The specific pattern may be one or more of a 2-dimensional pattern, a 3-dimensional pattern (e.g., built up in layers), or a 2-dimensional pattern on a 3-dimensional substrate (e.g., a non-planar substrate), according to various examples.

In particular, the ink deposition system 102 may be a printer 102 and the CIS apparatus 100 may be employed to supply liquid ink for use by the printer 102, according to some examples. For example, the printer 102 may be an inkjet printer and the liquid ink may be inkjet ink. In various examples, the printer 102 comprises a printhead 104 that includes a liquid ink ejector to eject the liquid ink as either droplets or a continuous stream. In various examples, the liquid ink ejector of the printhead 104 may eject the liquid ink according to any of a variety of techniques including, but not limited to, thermal resistance (e.g., thermal inkjet), piezoelectric deformation, and an ink pump to form the pattern on a substrate 106. The printer 102 may be used to print the pattern on a substrate 106 such as, but not limited to, paper, cardboard, cloth, plastic film (e.g., polyimide film, polyester film, polypropylene film, etc.), metal sheets, various ceramics, oxides, or semiconductor wafers, and a variety of non-planar structures (e.g., cans and bottles). For example, the pattern may comprise one or both of an image and text that is printed on a paper substrate 106 by the printer 102.

As illustrated, the CIS apparatus 100 comprises an off-axis ink supply 110. The off-axis ink supply 110 is configured to source liquid ink to the printhead 104 of the printer 102. As employed herein, the term 'off-axis' with respect to an ink source or supply is defined as not collocated with the printhead 104. In particular, the off-axis ink supply 110 is a supply of liquid ink that is not located on a moving assembly that carries and moves the printhead 104 relative to the substrate 106.

For example, the off-axis ink supply 110 may comprise one or more containers of liquid ink located adjacent to the printer 102. In another example, the off-axis ink supply 110 may comprise an ink reservoir built into a frame of the printer 102 but not collocated with the printhead 104. In various examples, the off-axis ink supply 110 facilitates replenishment of the liquid ink while the printer 102 is performing a printing job or task, e.g., printing a pattern. In particular, liquid ink may be added to the ink supply 110 without halting the print job of the printer 102, for example.

The off-axis ink supply 110 is connected to and in fluid communication with the printhead 104 by a fluid conduit 112. In some examples, the fluid conduit 112 comprises a tube. The tube may be a flexible tube to accommodate motion of the printhead 104, for example. The tube may be one of a plurality of tubes, each tube of the plurality supplying a different color or type of liquid ink, for example. In particular, the individual tubes of the plurality may supply liquid ink to different ones of a plurality of printheads 104 of the printer 102, for example.

The CIS apparatus 100 further comprises a one-way valve 120. The one-way valve 120 is positioned between the off-axis ink supply 110 and the printhead 104 along a flow path of the liquid ink. In some examples, the one-way valve 120 is located along the fluid conduit 112. For example, the one-way valve 120 may be located at a terminus of the tube adjacent to the printhead 104. In another example, the one-way valve 120 is located at a beginning of the fluid conduit 112. In yet another example, the one-way valve 120 is located within the tube away from either the terminus or the beginning of the fluid conduit 112. In other examples, the one-way valve 120 is located in a portion of the fluid conduit 112 other than the tube. For example, the one-way valve 120 may be integral to a housing of a fluid reservoir of the printhead 104, as described below.

According to various examples, the one-way valve 120 acts as a check valve to substantially limit, or substantially prevent in some examples, liquid ink from flowing in an upstream direction from the printhead 104 to the off-axis ink supply 110. In FIG. 1, a direction of flow of liquid ink established by the check valve action of the one-way valve 120 is indicated by an arrow 122, which points in a forward or downstream direction, as illustrated. In addition to acting as a check valve, the one-way valve 120 has a minimum negative activation pressure at a printhead side (i.e., downstream side) of the one-way valve.

In some examples, the minimum negative activation pressure of the one-way valve 120 is equivalent to a pressure of the ink at the printhead 104 that substantially minimizes, and in some examples substantially precludes, the liquid ink from leaking or 'drooling' from an ejection orifice of the printhead 104. In other words, the minimum negative activation pressure is more negative than an ink pressure at which printhead drooling is likely to take place or is considered to be a problem. In some example printers 102, an ink pressure of between about minus 1.0 and about minus 2.5 kilopascals (kPa) is sufficient to substantially preclude drooling. Thus, in some examples, the minimum negative activation pressure of the one-way valve 120 is selected to be less than or equal to about minus 1.0 kPa. In some examples, the minimum negative activation pressure is selected to be less than or equal to about minus 2.5 kPa. In some examples, the minimum negative activation pressure may be minus 3.0 kPa or less (i.e., a larger negative value).

Note, that the minimum negative activation pressure as defined and used herein is a lower bound on the negative activation pressure measured relative to the ambient pressure. Thus, the one-way valve 120 having a minimum negative activation pressure that is more negative than the minimum negative activation pressure that substantially prevents drooling is still within a scope defined herein. In other words, a one-way valve 120 having a minimum negative activation pressure of minus 1.75 kPa is explicitly within the scope of a minimum activation pressure of about minus 1.0 kPa, for example. In another example, a minimum negative activation pressure of minus 3.75 kPa is within the scope defined by a minimum activation pressure of about minus 2.5 kPa, and so on.

In various examples, the one-way valve 120 may have a structure selected from a number of structures for implementing one-way or check valves provided that the structure also accommodates the establishment of the minimum negative activation pressure. For example, the one-way valve 120 may be implemented as any of, but not limited to, a ball check valve, a diaphragm check valve, a swing or tilting disc check valve, and a duckbill check valve. Various means for selecting and establishing the minimum activation pressure of such check valves including, but not limited to, selecting a spring constant of a spring or another means of biasing an element of the check valve, may be employed. For example, a spring constant of a spring used to retain a sphere or spherical ball in an opening of a ball check valve may be used to establish a minimum negative activation pressure of the ball check valve when employed as the one-way valve 120.

In some examples as mentioned above, the one-way valve 120 may be integral to a fluid reservoir of the printhead 104. For example, the one-way valve 120 may be built into an ink cartridge or a similar structure that houses the fluid reservoir of the printhead 104. The built-in one-way valve 120 within the ink cartridge may be located in part or in whole within the fluid reservoir, for example. A portion of the one-way valve 120 may further extend into a housing of the ink cartridge to provide fluid communication between the fluid reservoir and an exterior of the ink cartridge. The fluid conduit 112, in turn, may comprise a tube that is connected to the portion of the one-way valve that passes through a wall of the housing as a valve port of the integral one-way valve 120, for example.

In other examples, the one-way valve 120 may be located along and within the fluid conduit 112 itself (e.g., an inline one-way valve), but outside or at least substantially outside of the ink cartridge. For example, the fluid conduit 112 may comprise a tube that is connected either to a housing of the ink cartridge or to a printhead assembly (PHA) that holds the printhead 104 in an absence of the ink cartridge (e.g., when the ink cartridge is removed). In these examples, the one-way valve 120 may be positioned somewhere along the tube, but is not integral with the housing or built in to the ink cartridge, for example. In another example, the one-way valve 120 is positioned somewhere along the tube and the tube with a terminus of the tube being connected to an ink reservoir (e.g., the ink reservoir of the ink cartridge).

Figure 2A:
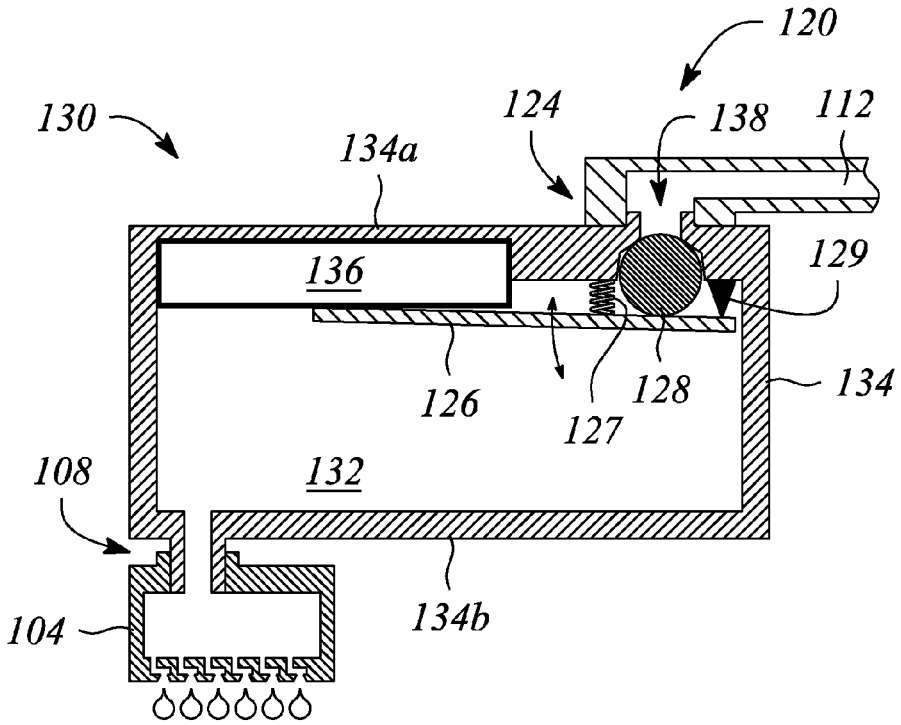
FIG. 2A illustrates a schematic cross sectional view of a one-way valve built into an ink cartridge, according to an example of the principles described herein.
Figure 2B:
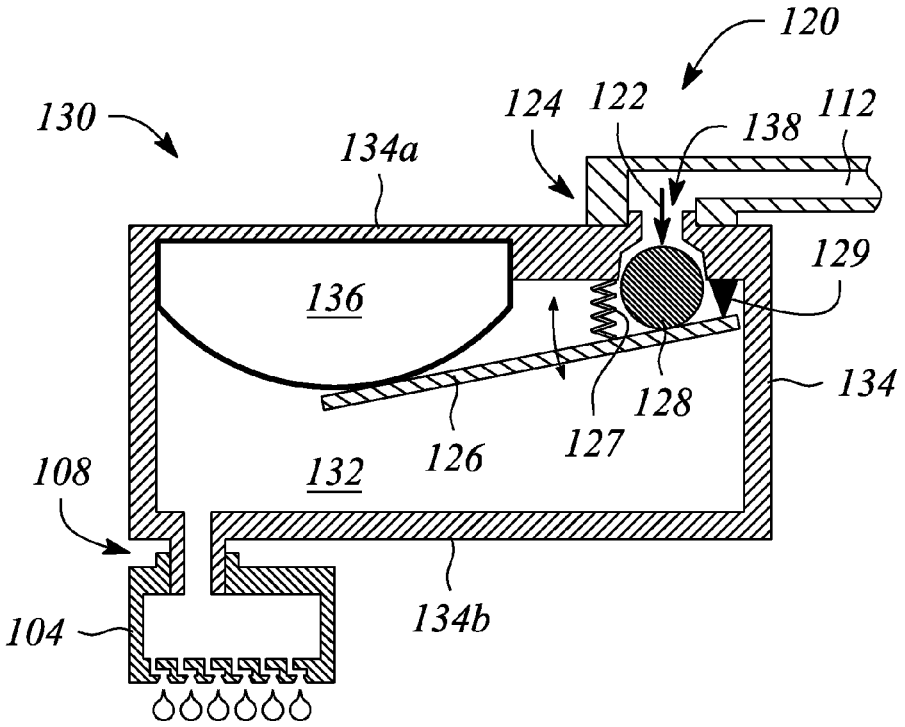
FIG. 2B illustrates a schematic cross sectional view of the one-way valve of FIG. 2A in an open configuration, according to an example of the principles described herein.
Figure 2C:
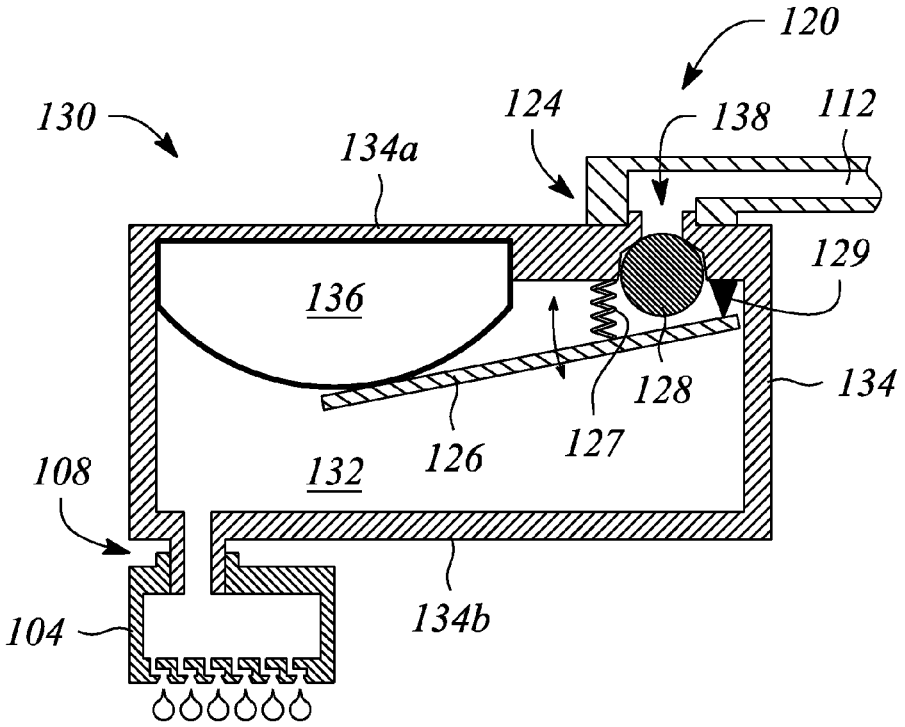
FIG. 2C illustrates a schematic cross sectional view of the one-way valve of FIG. 2A in a closed configuration, according to an example of the principles described herein.

FIG. 2A illustrates a schematic cross sectional view of a one-way valve 120 built into an ink cartridge 130, according to an example of the principles described herein. As illustrated in FIG. 2A, the one-way valve 120 is closed. FIG. 2B illustrates a schematic cross sectional view of the one-way valve 120 of FIG. 2A in an open configuration, according to an example of the principles described herein. FIG. 2C illustrates a schematic cross sectional view of the one-way valve 120 of FIG. 2A in another closed configuration, according to an example of the principles described herein.

In particular, FIGS. 2A-2C illustrate a cross section of the ink cartridge 130 associated with the printhead 104. As illustrated the ink cartridge 130 is separable from the printhead 104 at a connector 108. The connector 108 may serve as a liquid ink port of the printhead 104, for example. In other examples (not illustrated), the printhead 104 and the ink cartridge 130 may be substantially or even permanently connected. For example, the ink cartridge 130 may include the printhead 104.

The ink cartridge 130 comprises a fluid reservoir 132 that is configured to hold liquid ink for use by the printhead 104. A housing 134 substantially encloses and, in some examples, substantially defines the fluid reservoir 132. The ink cartridge 130 further comprises a variable chamber 136 within the housing 134 in fluid communication with the fluid reservoir 132. The variable chamber 136 is configured to expand and contract in response to pressure changes in the liquid ink within the fluid reservoir 132. Specifically, the variable chamber 136 expands when a pressure of the ink decreases and contracts as the ink pressure increases relative to an ambient pressure outside of the housing 134 and the fluid reservoir 132.

As illustrated in FIGS. 2A-2C, the one-way valve 120 is substantially located within the fluid reservoir 132 and comprises a valve port 124 formed through a wall of the housing 134 to access an exterior of the print cartridge 130. In some examples (e.g., as illustrated), the housing 134 provides or serves as a structural member of the one-way valve 120. As such, the one-way valve 120 is also integral to the housing 134, and by extension, is also integral to the ink cartridge 130.

Further illustrated in FIGS. 2A-2C, the fluid conduit 112 comprises a tube 112 connected to the valve port 124. In some examples, the valve port 124 may be located on a side of the ink cartridge 130 that is adjacent to another ink cartridge when installed in a printer 102, for example. A connection between the tube 112 and the valve port 124 may be configured to accommodate a relatively small spacing between adjacent ink cartridges in the printer 102. For example, the tube 112 may be connected to the valve port 124 using a low-profile, right-angle connector, to facilitate accessing the valve port 124 when the ink cartridge 130 is inserted in the printer 102 adjacent to other print cartridges.

The one-way valve 120 further comprises a lever 126 configured to move in response to an expansion and a contraction of the variable chamber 136 within the fluid reservoir 132. In particular, as the variable chamber 136 expands, the lever 126 is moved away from an upper wall 134*a* and toward a lower wall 134*b* of the housing 134, as illustrated by a double-headed arrow in FIG. 2B. The variable chamber 136 may expand in response to a decrease in ink pressure within the ink reservoir 132. The decrease in ink pressure may be produced as ink is consumed by the printhead 104, for example. A motion of the lever 126 in cooperation with the expansion and contraction of the variable chamber 136 may be constrained or resisted by a spring 127 or a similar bias element that acts against the movement of the lever 126 away from the upper wall 134*a*, for example. The lever may rest on and rotate about a fulcrum 129, in some examples.

The one-way valve 120 further comprises a sealing member 128 located between the lever 126 and an opening 138 in the housing 134 that leads to the valve port 124. The sealing member 128 is movable by or in response to movement of the lever 126. Specifically, the sealing member 128 is movable between a first position (see for example FIG. 2A) in which the opening 138 is substantially sealed (e.g., blocked by the sealing member 128) and a second position (see for example FIG. 2B) in which the opening 138 is unsealed. When sealed, fluid is prevented from passing through the opening 138 while when unsealed, fluid may pass therethrough. In some examples, the sealing member 128 is further movable into the first position by a positive ink pressure within the fluid reservoir 132 at a printhead side of the one-way valve 120. In particular, positive ink pressure moves the sealing member 128 into the first position and seals the opening 138, irrespective of a position of the lever 126 (see for example FIG. 2C). Positive pressure may be provided by using a pump (e.g., an air pump) to expand the variable chamber 136 as illustrated in FIG. 2C, for example.

In some examples, the sealing member 128 may comprise a substantially spherical ball (e.g., as illustrated in FIGS. 2A-2C). When the sealing member 128 is a spherical ball, the opening 138 may be a circular hole in the housing 134, for example. In the first position, the ball-shaped sealing member 128 may be pressed into and seal against a circular rim of the opening 138. In such examples, the housing 134 provides a structural member (e.g., the opening 138) of the one-way valve 120. In these examples, the one-way valve 120 is integral the to the housing 134. In other examples (not illustrated), the opening 138 (e.g., circular opening 138) may be provided by a structural member that is provided separately from the housing 134 and then affixed and sealed into the housing 134. When affixed and sealed to the housing 134, the separately provided structural member may be considered to be integral to the housing 134, for example.

In other examples, a size and a shape of the opening 138 depends on a size and a shape of the sealing member 128. In some examples, one or both of the sealing member 128 and a rim or other contact surface between the sealing member 128 and the opening 138 may comprise a hydrophilic material. The hydrophilic material may be a coating, for example. In other examples, one or both of the sealing member 128 and the rim or other contact surface may be formed from the hydrophilic material. The hydrophilic material may provide a lower bubble pressure at an interface between the sealing member 128 and opening 138, for example. The bubble pressure may be lower than the interface without the hydrophilic material, for example.

Figure 3:
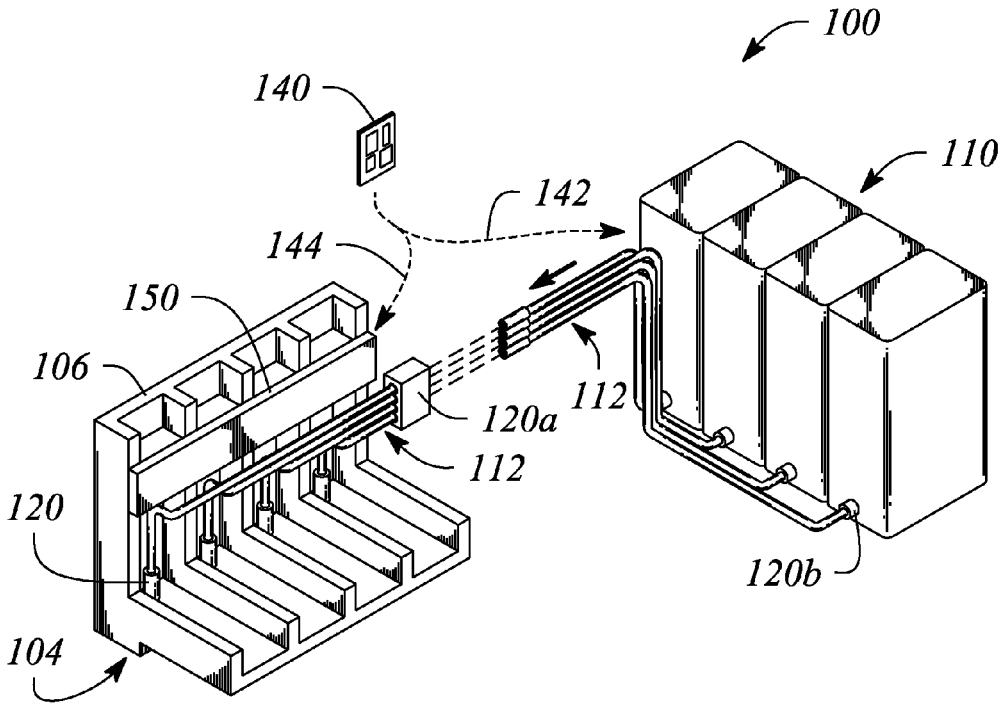
FIG. 3 illustrates a perspective view of a continuous ink supply (CIS) apparatus, according to another example of the principles described herein.

FIG. 3 illustrates a perspective view of a continuous ink supply (CIS) apparatus 100, according to another example of the principles described herein. In particular, the example illustrated in FIG. 3 represents a 'cartridge-less' configuration. For example, the cartridge-less configuration may be used with a printer 102 (not illustrated in FIG. 3) having printheads 104 supported by a printhead assembly 106. The printhead assembly 106 may be configured to accept print cartridges (not illustrated). However, when the CIS apparatus 100 is used with the printer, the ink cartridges are removed and the fluid conduit 112, illustrated as a plurality of tubes 112, is connected directly to a liquid ink port of the printhead assembly 106. The liquid ink port may be an input port of or associated with the printhead 104, for example. In such an arrangement, the fluid reservoir described above may be substantially absent. For example, the fluid reservoir may be located in the removed and absent ink cartridge. As illustrated in FIG. 3, the one-way valve 120 is positioned at a terminus of the tube 112 adjacent to the liquid ink port (e.g., within a connector attached to the liquid ink port). Alternative example locations for the one-way valve 120 include within a connector 120*a* in a mid-section of the tube 112 and at a beginning 120*b* of the tube 112 adjacent to the off-axis ink supply 110.

As liquid ink is consumed by the printhead 104, liquid ink flows from the off-axis ink supply 110 through the fluid conduit 112, through the one-way valve 120 and into the printhead 104 via the liquid ink port of the printhead assembly 106. An arrow illustrated next to the fluid conduit 112 (e.g., tubes 112) indicates a forward or downstream flow direction of the liquid ink to resupply the printhead 104.

As described above, the one-way valve 120 illustrated in FIG. 3 prevents liquid ink from flowing in an upstream direction away from the printhead 104. For example, if the off-axis ink supply 110 is placed below a level of the printhead 104, the one-way valve 120 prevents gravity from causing the liquid ink to flow from the printhead 104, upstream along the fluid conduit 112 and back into the off-axis ink supply 110. Also as above, the minimum negative activation pressure of the one-way valve 120 substantially prevents drooling from the printhead 104. For example, if the off-axis ink supply 110 is located above a level of the printhead 104, gravity will not cause the liquid ink flowing through the one-way valve to increase an ink pressure at the printhead side of the one-way valve 120 to a point that may lead to drooling.

In some examples, the CIS apparatus 100 further comprises a memory circuit 140. The memory circuit 140 is associated with the off-axis ink supply 110 and is configured by definition to provide information comprising one or both of an ink type and a remaining quantity of the liquid ink in the off-axis ink supply 110, for example. For example, the information may be provided to and used by the printer to display the ink type and the remaining quantity of the liquid ink to a user of the printer 102. In another example, the provided information may be used by the printer 102 to determine whether or not to conduct a printing operation and in some instances, which printhead 104 among a plurality of the printheads to employ given the ink type information. For example, the printer 102 may make a decision on conducting a print operation depending on whether or not enough ink remains to complete the print operation. In other examples, the memory circuit may contain information that indicates whether or not the CIS apparatus 100 is recognized and approved for use by the printer 102. In yet other examples, the memory circuit 140 may provide a variety of additional information to the printer 102 to facilitate printing when employing the CIS apparatus 100.

In some examples, the memory circuit 140 is implemented as an integrated circuit (IC) such as, but not limited to an application specific integrated circuit (ASIC). In some examples the memory circuit 140 resides or is physically located at the off-axis ink supply 110 (e.g., as indicated by dashed arrow 142). The memory circuit 140 may communicate to the printer via a communication channel, for example. In some examples, the communication channel comprises a plurality of wires (e.g., a wire harness) that connect between the printer 102 and the off-axis ink supply 110. For example, the wires (not illustrated) may follow or be routed along the fluid conduit 112 and ultimately plug into one or more connectors at the printhead assembly 106. In another example, the wires may simply connect into a connector somewhere else on the printer 102. In another example, the communications channel may comprise a wireless network channel between the off-axis ink supply 110 and the printer 102. For example, the communications channel may employ one or more of several wireless communication systems including, but not limited to, Bluetooth™ and IEEE 802.11 (e.g., WiFi) as a wireless communications channel. Bluetooth™ is a registered trademark of Bluetooth SIG, Inc., Bellevue, Wash., USA. IEEE 802.11 is a wireless communications standard promulgated by the Institute of Electrical and Electronic Engineers, Inc., Piscataway, N.J., USA.

In some examples, the memory circuit 140 (i.e., also referred to as an 'memory chip') one of augments and replaces information from a similar memory circuit or chip normally provided by an ink cartridge of the printhead assembly 106. For example, as illustrated in FIG. 3, the ink cartridge of the printhead assembly 106 is removed and the memory circuit 140 replaces the information from the similar memory circuit of the ink cartridge.

In some examples, the CIS apparatus 100 further comprises an adapter 150 supported by the printhead assembly 106. For example, the adapter 150 may be a single bar-shaped adapter 150, as illustrated. In other examples, a plurality of adapters may be employed (not illustrated). The adapter 150 facilitates connecting the communications channel to the printer 102 in place of the ink cartridge memory circuit, according to some examples. In particular, the adapter 150 may connect to a connector of the printer 102 or the printhead assembly 106 that normally serves as a connection point for the ink cartridge memory circuit connector. In some examples, the adapter 150 is connected to wires (not illustrated) that provide the communication channel between the off-axis ink supply 110 and the printer 102. In other examples, the adapter 150 may carry a circuit that provides the wireless network channel to the memory circuit 140 at the off-axis ink supply 110.

In yet other examples (not illustrated), the memory circuit 140 may be located at and carried by the adapter 150 itself (e.g., as indicated by dashed arrow 144). In some of these examples, a communications channel to the off-axis ink supply 110 may not be required. In other of these examples, the communications channel may be used to relay only certain, supply-specific data (e.g., ink level measurements) from the off-axis ink supply to the memory circuit 140 on the adapter 150, for example. Other functions of the memory circuit 140 may be performed at the adapter 150 without communication with the off-axis ink supply 110, for example.

In another example (not illustrated), the connecting wires from the memory circuit 140 of the off-axis ink supply 110 may plug into an auxiliary port of the printer while the ink cartridge remains connected to or installed in the printhead assembly 106. For example, when the fluid conduit 112 connects to the valve port 124 of the one-way valve 120 that is integral to the ink cartridge (illustrated in FIGS. 2A-2C), an auxiliary port may be provided to receive and connect with wires that provide the communications channel with the memory circuit 140 associated with the off-axis ink supply. The auxiliary port may be provided on the ink cartridge for example and the communication channel wires may connect to the printer 102 through the ink cartridge. As such, the information from the memory circuit 140 may augment instead of replace the information provided by the memory circuit of the ink cartridge, for example.

Figure 4:
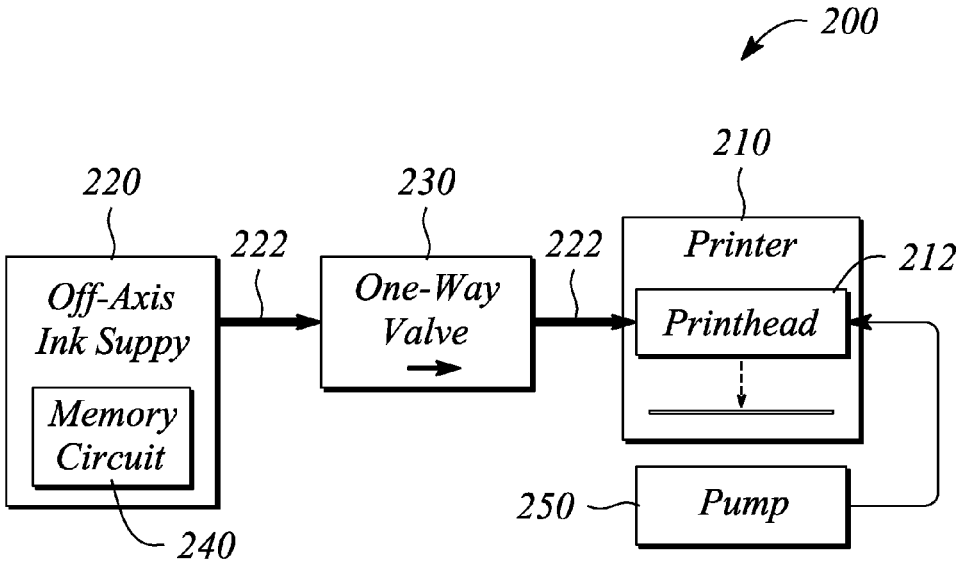
FIG. 4 illustrates a block diagram of a continuous ink supply (CIS) printer system, according to an example of the principles described herein.

FIG. 4 illustrates a block diagram of a continuous ink supply (CIS) printer system 200, according to an example of the principles described herein. The CIS printer system 200 comprises a printer 210. The printer 210 has a printhead 212 to receive liquid ink. In some examples, the printer 210 and printhead 212 may be substantially similar to the printer 102 and printhead 104, described above with respect to the CIS apparatus 100. The liquid ink is provided to the printhead 212 by an off-axis ink supply 220 using a fluid conduit 222, for example. The fluid conduit 222 may comprise one or more tubes, for example. In some examples, the off-axis ink supply 220 and associated fluid conduit 222 may be substantially similar to the off-axis ink supply 110 and the fluid conduit 112, respectively, as described above with reference to the CIS apparatus 100. According to some examples, the CIS printer system 200 may further comprise the off-axis ink supply 220.

The CIS printer system 200 further comprises a one-way valve 230. The one-way valve 230 is configured to control a flow of the liquid ink to the printhead 212 through the fluid conduit 222. In some examples, the one-way valve 230 is substantially similar to the one-way valve 120 described above with respect to the CIS apparatus 100. In particular, the one-way valve 230 has a minimum negative activation pressure that is selected to substantially minimize printhead drooling. In some examples, the minimum negative activation pressure is at least about minus 1.0 kPa at a printhead side of the one-way valve 230. In some examples, the one-way valve 230 is located one of along the fluid conduit 222 (e.g., as illustrated) and integral to a housing wall of an ink cartridge (not illustrated) adjacent to the printhead 212.

In some examples, the CIS printer system 200 further comprises a memory circuit 240 associated with the off-axis ink supply 220, according to some examples. The memory circuit 240 is configured to provide information comprising characteristics of the liquid ink of the off-axis ink supply 220, in some examples. For example, the characteristics may include, but are not limited to, one or more of an ink type, an ink color, and an amount of ink remaining in the off-axis supply 220. In some examples, the provided information is transmitted to the printer 210 by way of a communication channel to one of augment and replace information from a similar memory circuit normally provided by an ink cartridge used with the printer 210. The information may be employed to facilitate printer operation. For example, the information may be employed by the printer 210 to report status to a user of the printer 210. In some examples, the memory circuit 240 and the communications channel are substantially similar to the memory circuit 140 and the communication channel described above with respect to the CIS apparatus 100.

In some examples, the CIS printer system 200 further comprises a pump 250. The pump 250 is configured to provide positive ink pressure between the printhead 212 and the one-way valve 230 in support of air management and printhead maintenance functions of the printer 210. For example, the positive ink pressure may be employed to expel and thereby remove air that may become trapped or entrained in the printhead 212 and associated fluid pathways. In another example, the positive ink pressure may be used to prime the printhead 212 by pushing liquid ink into a firing chamber of the printhead 212. The one-way valve 230 acts to substantially prevent liquid ink from flowing upstream, i.e., away from the printhead, for example to the off-axis ink supply 220 during instances where the pump 250 is providing the positive ink pressure, for example.

Figure 5:
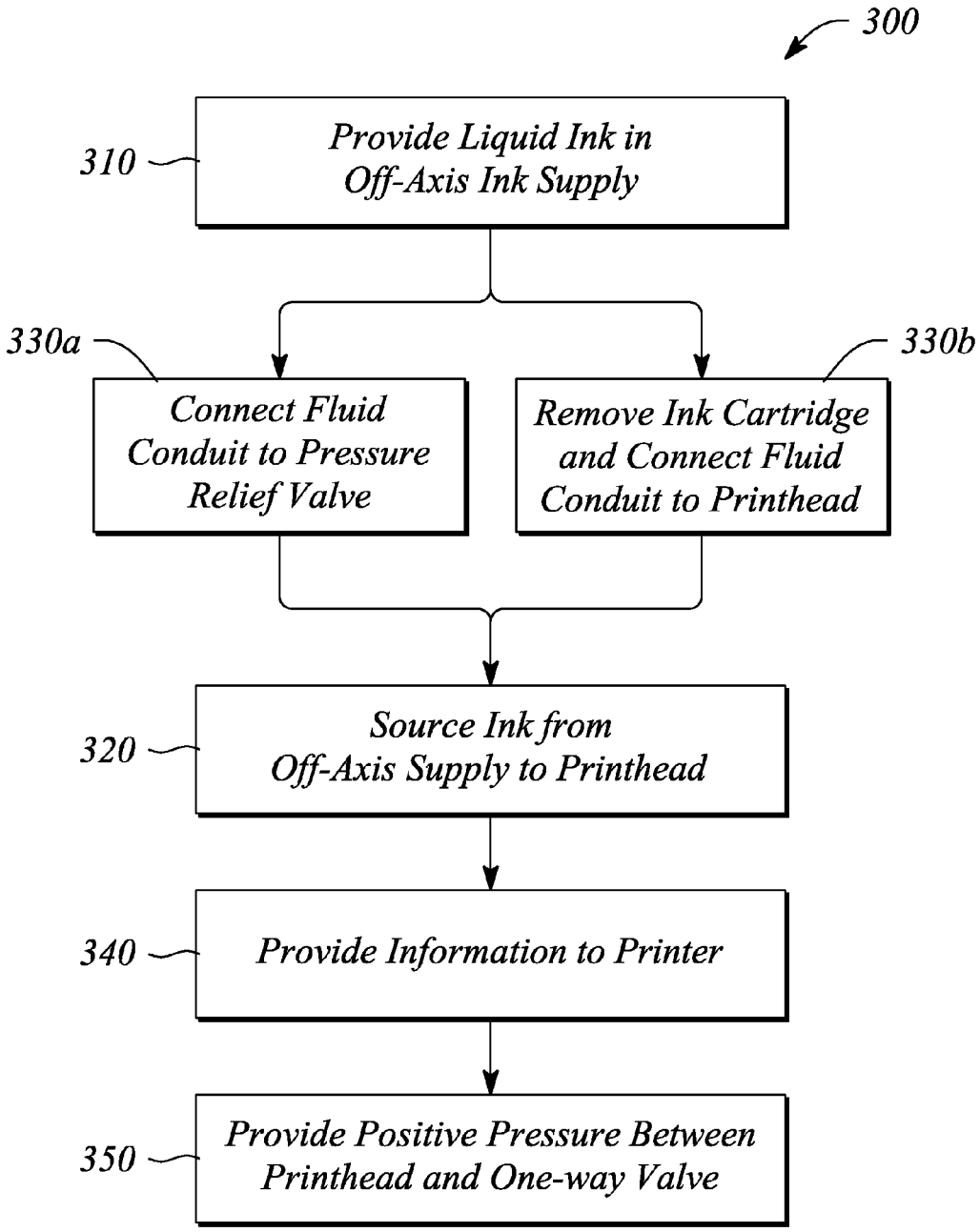
FIG. 5 illustrates a flow chart of a method of continuous ink supply (CIS) used with a printer, according to an example of the principles described herein.

FIG. 5 illustrates a flow chart of a method 300 of continuous ink supply (CIS) used with a printer, according to an example of the principles described herein. Method 300 of CIS comprises providing 310 liquid ink in an off-axis ink supply. The liquid ink and the off-axis ink supply may be substantially similar to the liquid ink and off-axis ink supplies 110, 220 described above with respect to either of the CIS apparatus 100 and the CIS printer system 200, according to some examples.

The method 300 of CIS further comprises sourcing 320 the liquid ink from the off-axis ink supply to a printhead of a printer. The liquid ink is sourced 320 through a fluid conduit using a one-way valve positioned along the fluid conduit between the off-axis ink supply and the printhead. Specifically, the liquid ink is sourced 320 by passing through and being acted upon by the one-way valve. In some examples, the one-way valve is substantially similar to the one-way valve 120, 230 described above with respect to either of the CIS apparatus 100 or the CIS printer system 200. In particular, the one-way valve has a minimum negative activation pressure at a printhead side (i.e., downstream side) of the one-way valve. The minimum negative activation pressure substantially prevents drooling of the printhead, for example. The one-way valve further substantially prevents liquid ink from flowing upstream when a positive ink pressure exists at the downstream side of the one-way valve, for example. According to some examples, the minimum negative activation pressure of the one-way valve is less than or equal to about minus 1.0 kPa, or less than or equal to about minus 2.5 kPa, or within a range of about minus 1.0 kPa and about minus 3.75 kPa.

In some examples, the method 300 of CIS further comprises one of connecting 330*a* the fluid conduit to a pressure relief valve of an ink cartridge that supplies ink to the printhead and removing 330*b* the ink cartridge from the printhead and connecting the fluid conduit to the printhead. When the fluid conduit is connected 330*a* to the pressure relief valve of the ink cartridge, the one-way valve comprises the pressure relief valve. In other words, the pressure relief valve provides the operational characteristics of the one-way valve, for example. In the examples where the ink cartridge is removed 330*b*, the one-way valve may be positioned along the fluid conduit, for example at a location where the fluid conduit is connected to the printhead or a location upstream of where the fluid conduit is connected to the printhead. The connection to the printhead may be by way of a liquid ink port of a printhead assembly that supports the printhead, for example. In yet another example (not illustrated in FIG. 5), connecting the fluid conduit comprises inserting the fluid conduit having the one-way valve into the ink cartridge by means other than connecting to the pressure relief valve.

In some examples, the method 300 of CIS further comprises providing 340 information to the printer regarding characteristics of the off-axis liquid ink supply. The information is provided 340 to one of augment and replace information normally provided by an ink cartridge of the printer. In some examples, the information is provided 340 by a memory circuit associated with the off-axis ink supply. The memory circuit may be substantially equivalent to the memory circuit 140, 240 described above with respect to either of the CIS apparatus 100 or the CIS printer system 200. In some examples, providing 340 information comprises transmitting the information to the printer by way of a communication channel. In various examples, the communications channel may be either a wired communications channel or a wireless communications channel (e.g., WiFi, Bluetooth™, etc.).

In some examples, the method 300 further comprises providing 350 positive ink pressure between the printhead and the one-way valve. The positive pressure may be provided using a pump for example. In some examples, the provided 350 positive pressure supports air management and printhead maintenance functions of the printer. Generally, providing 350 positive pressure may be performed only intermittently and may be performed either prior to (not illustrated) or following providing 340 information, for example. For example, air management may be an issue only when air becomes entrained or trapped in the printhead or in associated fluid pathways thereof.

Thus, there have been described examples of a continuous ink supply (CIS) apparatus, a CIS printer system and a method of CIS that employ a one-way valve having a minimum negative activation pressure. It should be understood that the above-described examples are merely illustrative of some of the many specific examples that represent the principles described herein. Clearly, those skilled in the art can readily devise numerous other arrangements without departing from the scope as defined by the following claims.

What is claimed is:

1. A continuous ink supply (CIS) apparatus comprising:

an off-axis ink supply to source liquid ink to a printhead of a printer; and a one-way valve positioned along a fluid conduit between the off-axis ink supply and an input port of the printhead to control a flow of the liquid ink to the printhead through the fluid conduit, the one-way valve is directly connected to the input port of the printhead and provides a minimum negative activation pressure at a printhead side of the one-way valve, the minimum negative activation pressure being at least enough to substantially preclude drooling from the printhead.

2. The CIS apparatus of claim 1, wherein the minimum negative activation pressure is more negative than about minus 1.0 kilopascals (kPa).

3. The CIS apparatus of claim 1, wherein the fluid conduit comprises a tube that is one of connected to a housing of an ink cartridge that houses a fluid reservoir of the printhead and connected to a printhead assembly that holds the printhead in an absence of the fluid reservoir, the one-way valve being positioned along the tube.

4. The CIS apparatus of claim 1, further comprising a memory circuit associated with the off-axis ink supply, the memory circuit to provide information comprising one or both of an ink type in the off-axis ink supply and remaining quantity of the liquid ink in the off-axis ink supply.

5. A printer that employs the CIS apparatus of claim 1, the printer comprising the printhead mounted in a movable printhead assembly to support and position the printhead, the printer further comprising a pump to provide positive ink pressure at the printhead side of the one-way valve, wherein the positive pressure supports air management and printhead maintenance functions of the printer.

6. The printer of claim 5, wherein the fluid conduit of the CIS apparatus connects to the printhead in the printhead assembly in place of an ink cartridge of the printer, the CIS apparatus further comprising a memory circuit associated with the off-axis ink supply, the memory circuit providing information regarding characteristics of the liquid ink in the off-axis ink supply, wherein the provided information replaces information from a memory circuit normally provided by the ink cartridge.

7. The CIS apparatus of claim 1, wherein the minimum negative activation pressure of the one-way valve is equal to or more negative than minus 3.0 kilopascals (kPa).

8. A continuous ink supply (CIS) printer system comprising:

a printer having a printhead to receive liquid ink from an off-axis ink source through a fluid conduit; and a one-way valve to control a flow of the liquid ink to the printhead through the fluid conduit, the one-way valve having a minimum negative activation pressure of less than or equal to about minus 1.0 kilopascals (kPa) at a printhead side of the one-way valve, wherein the one-way valve is located along the fluid conduit that is directly connected to an input port of the printhead to replace an ink reservoir in fluid communication with the printhead.

9. The CIS printer system of claim 8, further comprising:

the off-axis ink source; and a memory circuit associated with the off-axis ink source, the memory circuit providing information comprising characteristics of the liquid ink provided by the off-axis ink source, wherein the provided information is transmitted to the printer by way of a communication channel to one of augment and replace information from a memory circuit of an ink cartridge used with the printer.

10. The CIS printer system of claim 8, wherein the printer comprises:

a movable printhead assembly to support and position the printhead; and a pump to provide positive ink pressure between the printhead and the one-way valve, the positive pressure to support air management and printhead maintenance functions of the printer.

11. The CIS printer system of claim 10, further comprising:

a memory circuit associated with the off-axis ink source, the memory circuit providing information comprising one or both of ink type and remaining quantity of the liquid ink in the off-axis ink source, wherein the provided information is employed by the printer to report status to a user of the printer; and an adapter to connect to the movable printhead assembly, the adapter carrying the memory circuit.

12. A method of continuous ink supply (CIS), the method comprising:

providing liquid ink in an off-axis ink supply;

sourcing the liquid ink from the off-axis ink supply to a printhead of a movable printhead assembly of a printer through a fluid conduit using a one-way valve positioned along the fluid conduit between the off-axis ink supply and an input port of the printhead, the one-way valve is directly connected to the input port of the printhead and provides a minimum negative activation pressure at a printhead side of the one-way valve that is equal to or more negative than minus 1.0 kilopascals (kPa).

13. The method of CIS used with a printer of claim 12, further comprising one or more of:

providing information to the printer regarding characteristics of the liquid ink supply to one of augment and replace information normally provided by an ink cartridge of the printer, wherein providing information comprises transmitting the information to the printer by way of a communication channel;

providing a positive ink pressure between the printhead and the one-way valve using a pump, the positive pressure supporting air management and printhead maintenance functions of the printer; and one of (a) connecting the fluid conduit to a pressure relief valve of an ink cartridge that supplies ink to the printhead, the one-way valve comprising the pressure relief valve, and (b) removing the ink cartridge from the movable printhead assembly and connecting the fluid conduit to the printhead.

14. The method of CIS of claim 12, further comprising one of:

(a) connecting the fluid conduit to a pressure relief valve of an ink cartridge that supplies ink to the printhead, the one-way valve comprising the pressure relief valve; and (b) removing an ink cartridge from the movable printhead assembly of the printer and directly connecting the fluid conduit to the printhead.

15. The method of CIS of claim 12, wherein the minimum negative activation pressure of the one-way valve is equal to or more negative than minus 3.0 kilopascals (kPa).

* * * * *